US006657111B2

(12) United States Patent
Minakuchi

(10) Patent No.: US 6,657,111 B2
(45) Date of Patent: Dec. 2, 2003

(54) STRUCTURE BODY FORMED BY RIB MEMBER AND PLATE MEMBERS

(75) Inventor: Kiyoshi Minakuchi, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/852,606

(22) Filed: May 10, 2001

(65) Prior Publication Data

US 2001/0042433 A1 Nov. 22, 2001

(30) Foreign Application Priority Data

May 16, 2000 (JP) ..... 2000-143510

(51) Int. Cl.[7] ..... G10D 3/00
(52) U.S. Cl. ..... 84/291; 84/275; 84/290
(58) Field of Search ..... 84/291, 275, 290, 84/267

(56) References Cited

U.S. PATENT DOCUMENTS 627,186 A * 6/1899 Hagberg ..... 84/275
1,959,530 A * 5/1934 Gerber ..... 84/291
4,213,374 A * 7/1980 Husler ..... 411/459

FOREIGN PATENT DOCUMENTS

| | | | |
|---|---|---|---|
| DE | 4325205 | * | 7/1993 |
| JP | 55-2460 | | 1/1980 |
| JP | 2001070187 | * | 9/1999 |

* cited by examiner

*Primary Examiner*—Shih-Yung Hsieh
(74) *Attorney, Agent, or Firm*—Dickstein, Shapiro, Morin & Oshinsky, LLP.

(57) ABSTRACT

A bonding structure is provided, which is capable of eliminating overflow of the adhesive to the outside of the body, and which is capable of eliminating generation of a shrinkage cavity. The cross-section of a rib member 10 is to have approximate H shaped cross section, which shape is formed by an internal flange 11 and an external flange 12, each connected by a web 13, and the plate members are adhered to the top and bottom surfaces 11A and 11B of the internal flange 11.

8 Claims, 6 Drawing Sheets

STRUCTURE BODY FORMED BY RIB MEMBER AND PLATE MEMBERS

BACKGROUND OF THE INVENTION

1. Field of the Invention

The present invention relates to a structure body formed by a rib member and two plate members which form external surfaces of a hollow structure body or a solid structure body.

2. Description of the Related Art

Conventionally, a hollow structure body or a solid structure body are formed by bonding two plate members forming external surfaces which face each other with a frame member forming a rib member. A representative example of such a hollow or solid structural body is the body structure of a string instrument.

The present inventors have disclosed a conventional structural example related to the body structure of a string instrument as shown in FIG. 6 (Japanese Unexamined Patent Application, First Publication No. 2000-276167). In the body structure shown in FIG. 6 and in FIG. 7, which is a cross-sectional view of FIG. 6, reference numeral 3 denotes a body of a string instrument such as an electric guitar, which is constituted in appearance by a frame member called a rib member 30 forming the side surface of the body, a front board 31 and a rear board 32. The end portions of the front board 31 and the rear board 32 are securely adhered to a step portion 30A of the rib member 30. It is noted that the rib member 30 is made of a light alloy such as aluminum or a synthetic resin into a shape shown in FIG. 8.

On the other hand, a panel body 4 shown in FIG. 9 is known, which has a similar body structure to that of the above-described string instruments and is used for forming, for example, a wall surface. This panel body 4 is composed of a body side frame 40, made of a light alloy or a synthetic resin, and two panel plates 41 and 42, shown in a cross-sectional view in FIG. 10. The peripheral end portions of these two panel plates 41 and 42 are fitted to the step portion 40A of the side frame 40.

However, when considering the above-described string instrument as a representative example of a conventional bonding structure of the end portion of the plate member, the rib member 30 must be formed with sufficient thickness, in order to stabilize the overall body structure and to maintain the strength of the body so as to stabilize the tension of the strings. The body side frame 40 of the panel body 4 is usually formed with sufficient thickness so as to provide a stable shape and to maintain the strength of the panel body 4.

As shown above, the rib member 30 and the body side frame 40 are formed into a thick frame form in order to obtain the required level of rigidity. However, the thick frame form such as the thick rib members or thick body side frames shrink due to the intrinsic mold shrinkage rate during molding and shrinkage cavities are likely to be generated by shrinkage at the center part or the thick part of the material caused by the delayed cooling during molding as shown by the symbol G in FIGS. 7 and 10.

As described above, the end portions of the plate members are fit to the step portion and adhered to the rib members or frames. In the case of the body of the electric guitar, first, the adhesive P is coated on the surface of the step portion 30A of the body frame 30, as shown in FIG. 11. Subsequently, the peripheral ends of both of the front board 31 and rear board 32 are fit and pressed to the end surface of the step portion 30A for adhering to the rib member 30, then the adhesive P overflows from the outer surface of the abutted portion, as shown in FIG. 12.

When the adhesive overflows from the outer surface, the appearance and the quality of the products deteriorate.

Although it is necessary to remove the overflowed adhesive, the removal of the overflowed adhesive is not easy because the adhesive permeates into the edge portions of the boards 31 and 32, because these boards are made of wood. When the boards are made of synthetic resin, the removal of the overflowed adhesive is also not easy because of the intimacy of the synthetic resin with the adhesive. In addition, since the body frame is generally finished into an accurately finished form, which does not require further processing, the overflow of the adhesive from, for example, the mirror finished surface must be eliminated.

SUMMARY OF THE INVENTION

The present invention was made for solving the above-described problems and the present invention provides a bonding structure, which is capable of bonding the end portion of the board member to the body side frame without overflow of the adhesives to the outside surface of the bonded structure and, which is also capable of preventing formation of shrinkage cavities in the rib members or the frames.

According to the first aspect of the present invention, a structure body is provided which comprises, a first member having a first protrusion protruding in a first direction and a second protrusion protruding towards a second direction and a second member having a front surface and a rear surface and end portions, wherein said first protrusion of said first member is in contact with an end portion of said second member, and said second protrusion of said second member is adhered to a rear surface of said second member.

According to the second aspect of the present invention, in the structure body according to the first aspect said structure body further comprising a third member, and said first member further comprises a third protrusion and a fourth protrusion both protruding in the second direction, and wherein said third protrusion is adhered to the edge of the third member and said fourth protrusion is adhered to the rear surface of the third member.

According to the third aspect, in the structure body according to the second aspect, said first member is approximate the H shaped.

According to the fourth aspect, in the structure body comprising a plurality of members according to the first aspect, said second member corresponds to a board of a string instrument.

According to the fifth aspect, in the structure body comprising a plurality of members according to the first aspect, said second member corresponds to a panel plate of a panel body.

According to the sixth aspect, in the structure body comprising a plurality of members according to the first aspect, said first member is formed as a hollow body.

According to the seventh aspect, a string instrument comprises a rib member having an internal flange and an external flange at the end portion, boards each having a front surface and a rear surface, and said internal flange of said rib member is adhered to rear surfaces of said boards.

According to the eighth aspect, in the string instrument according to the seventh aspect, said rib member has an H shaped cross-section.

According to the ninth aspect, in the string instrument according to the seventh aspect, said rib member is formed as a hollow member.

According to the tenth aspect, in the string instrument according to the seventh aspect, a body of a guitar is formed by adhering said boards to said rib member.

DETAILED DESCRIPTION OF THE INVENTION

Hereinafter, a few embodiments of the present invention are described in detail with reference to the attached drawings. The bonding structure body of a string instrument such as an electric guitar and a panel body are described below as an representative embodiments of the present invention. However, it is noted that the same bonding structure can be applied to a wide range of products.

Figure 1:
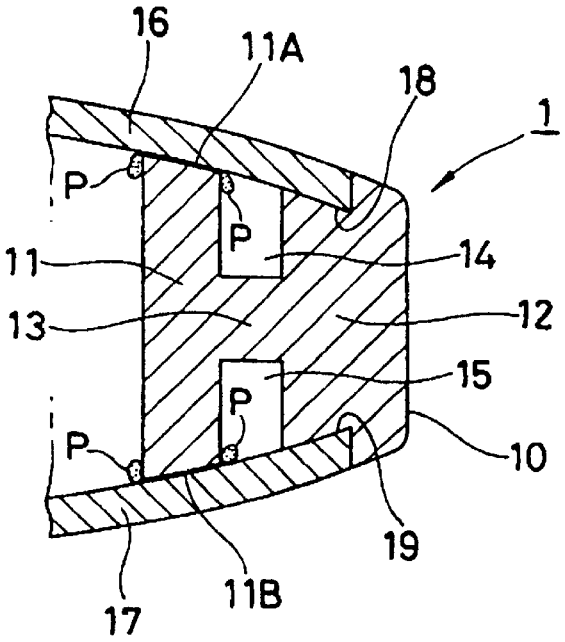
FIG. 1 is a cross-sectional view showing a bonding structure of a string instrument according to the present invention.

FIG. 1 is a cross-sectional view of a bonding structure applied to a body 1 of a string instrument (an electric guitar). Reference numeral 10 denotes a rib member. The rib member 10 is approximate H shaped cross section, in which an internal flange 11 and an external flange 12 is connected by a web 13, and two upper and lower grooves 14 and 15 are formed between the internal flange 11 and the external flanges 12. The step portions 18 and 19 are formed on the upper and lower ends of the external flange 12 in order to fit and position the front board and the rear board respectively to both step portions 18 and 19.

Figure 2:
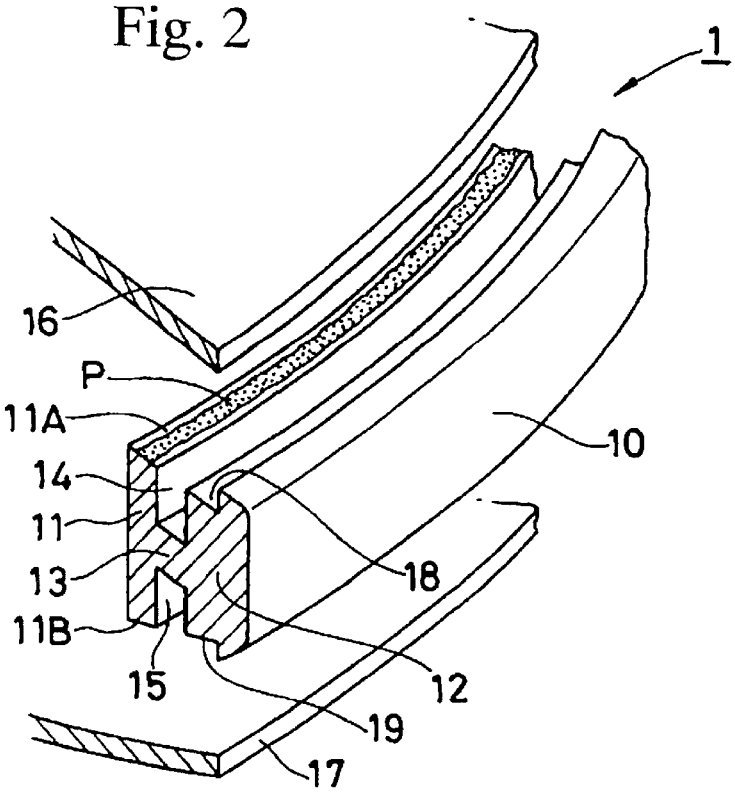
FIG. 2 is a perspective view showing the assembly process of the bonding structure shown in FIG. 1.

As shown in FIG. 2, the rib member 10 configured as described above is assembled with the front board 16 and the rear board 17 by coating the adhesive on the top and bottom surfaces 11A and 11B of the internal flange 11 and by fitting both ends of the front board 16 and the rear board 17 respectively to the step portions 18 and 19. When the front board 16 and the rear board 17 are assembled with the rib member 10, the excess adhesive P overflows into the rear surfaces of both boards and the vertical wall defining the upper and lower grooves 14 and 15, shown in FIG. 1.

Figure 3:
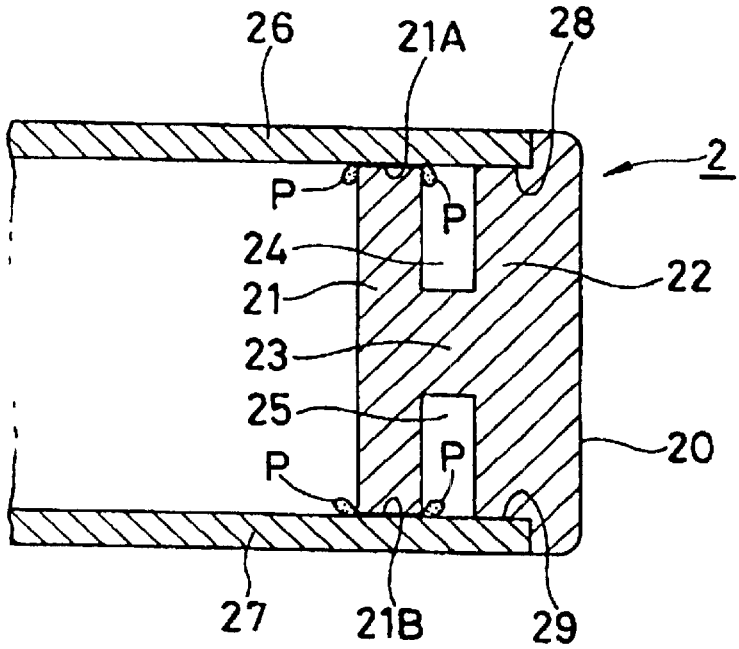
FIG. 3 is a cross-sectional view showing a bonding structure of an exterior member according to the present invention.

FIG. 3 shows a cross-sectional view of a body side frame 2 to which the present invention is applied. Reference numeral 20 denotes the body side frame. The body side frame 20 is approximate H shaped cross-section, in which an internal flange 21 and an external flange 22 are connected by a web 23 and two grooves 24 and 25 are formed between the internal and the external flanges 21 and 22. On both top and bottom surfaces of the external flange 22, step portions 28 and 29 are provided in order to position the panel plates 26 and 27 by fitting the ends of these panel plates to the step portions.

The body side frame 20 is formed as described above, and the adhesive is coated on the top and bottom surfaces 21A and 21B of the internal flange 21 and both ends of the panel plates 26 and 27 are fitted to the step portions 28 and 29 and adhered to the body side frame 20 while pressing the panel plates 26 and 27. When the panel plates 26 and 27 and the outside frame 20 are assembled as shown above, the excess adhesive P overflows on the rear surface of the panel plates 26 and 27 and into the grooves near the internal flange 21 as shown in FIG. 3.

Figure 4:
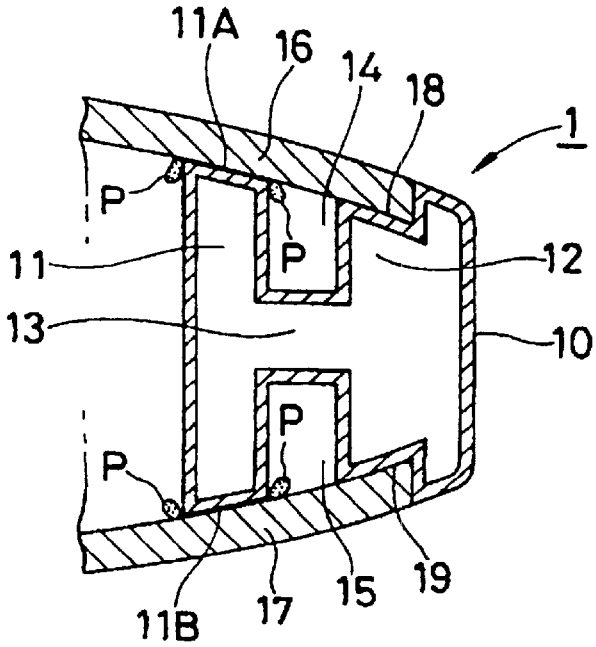
FIG. 4 is a cross-sectional view showing a modified embodiment of the bonding structure shown in FIG. 1.
Figure 5:
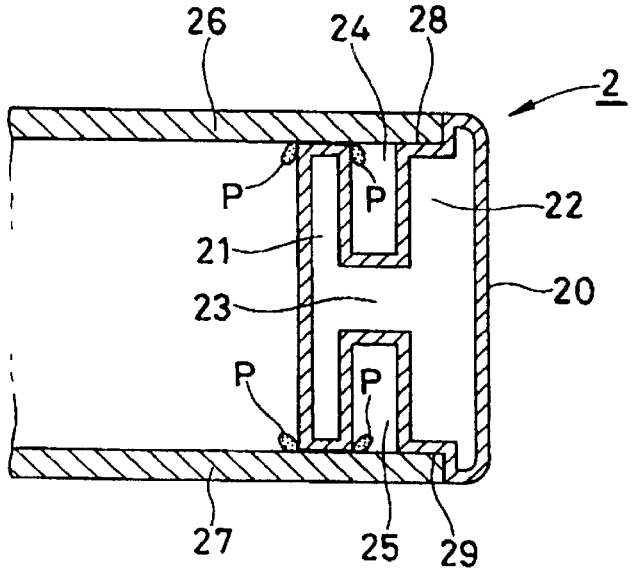
FIG. 5 is a cross-sectional view showing a modified embodiment of the bonding structure shown in FIG. 3.
Figure 6:
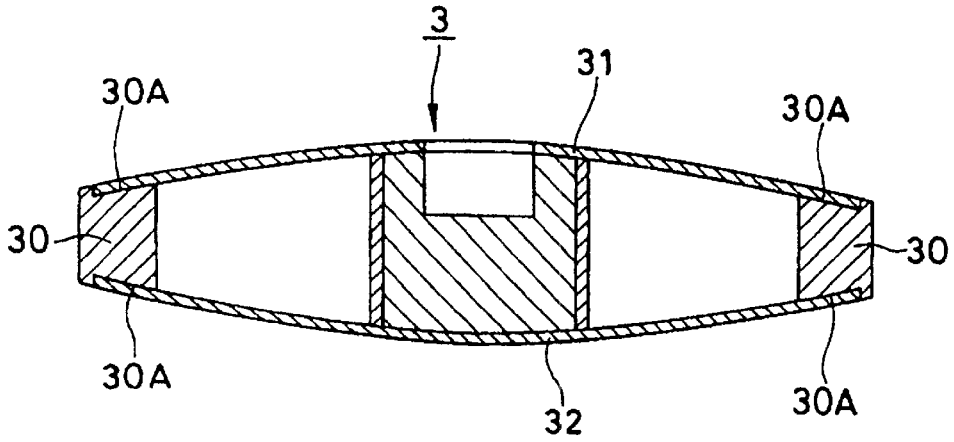
Fig. 6 PRIOR ART
FIG. 6 is a cross-sectional view showing an example of a conventional bonding structure of a string instrument.
Figure 7:
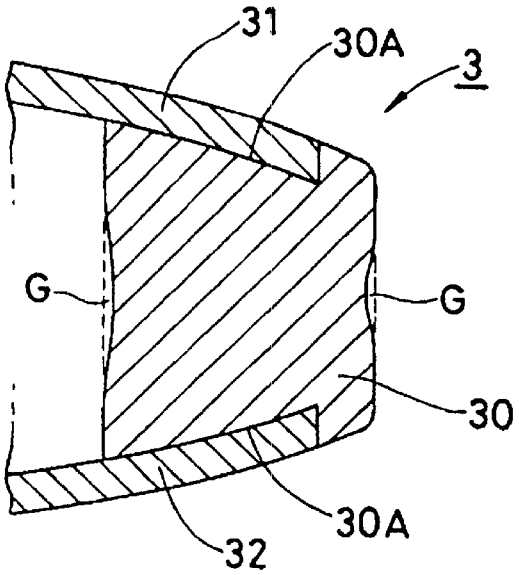
Fig. 7 PRIOR ART
FIG. 7 is a cross-sectional view showing a bonded state of the body frame with the end portion of the board of a string instrument shown in FIG. 6.
Figure 8:
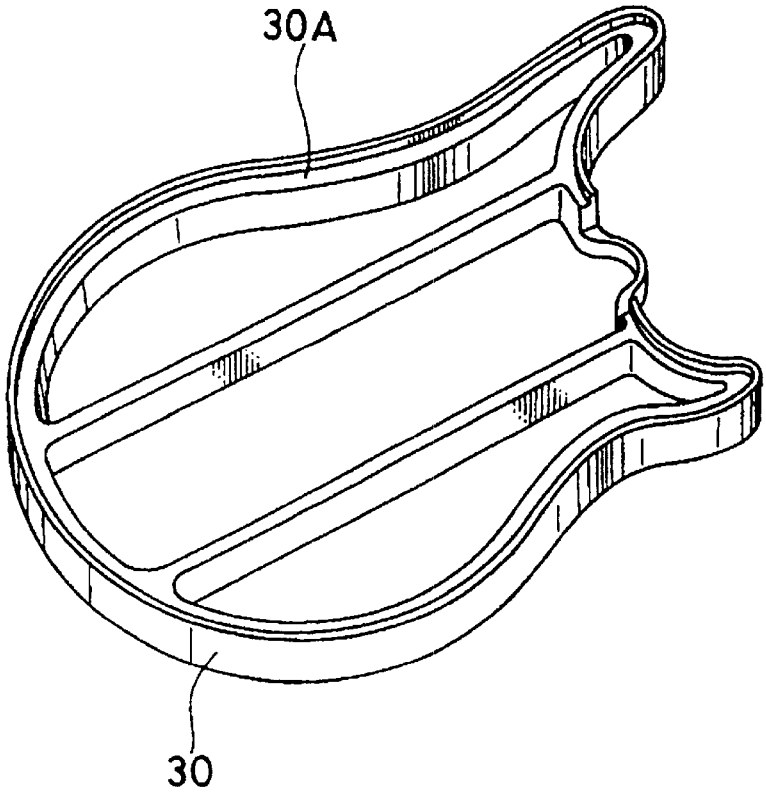
Fig. 8 PRIOR ART
FIG. 8 is a perspective view of a body frame of the string instrument shown in FIG. 6.
Figure 9:
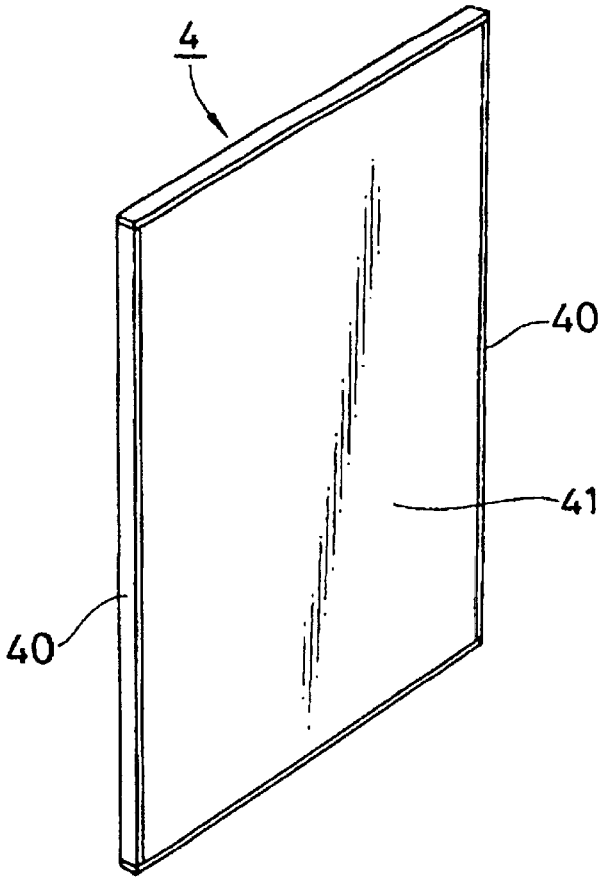
Fig. 9 PRIOR ART
FIG. 9 is a perspective view of an exterior member.
Figure 10:
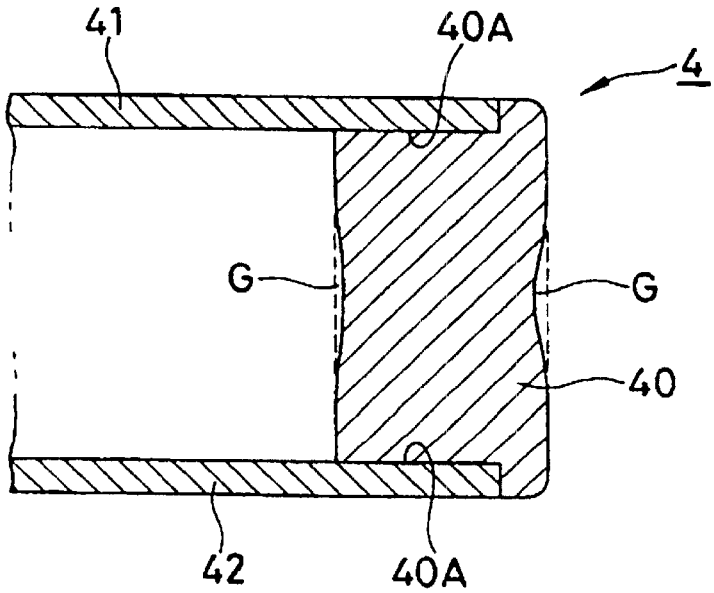
Fig. 10 PRIOR ART
FIG. 10 is a cross-sectional view showing the bonded state of the exterior frame and the panel plate of the exterior member shown in FIG. 9.
Figure 11:
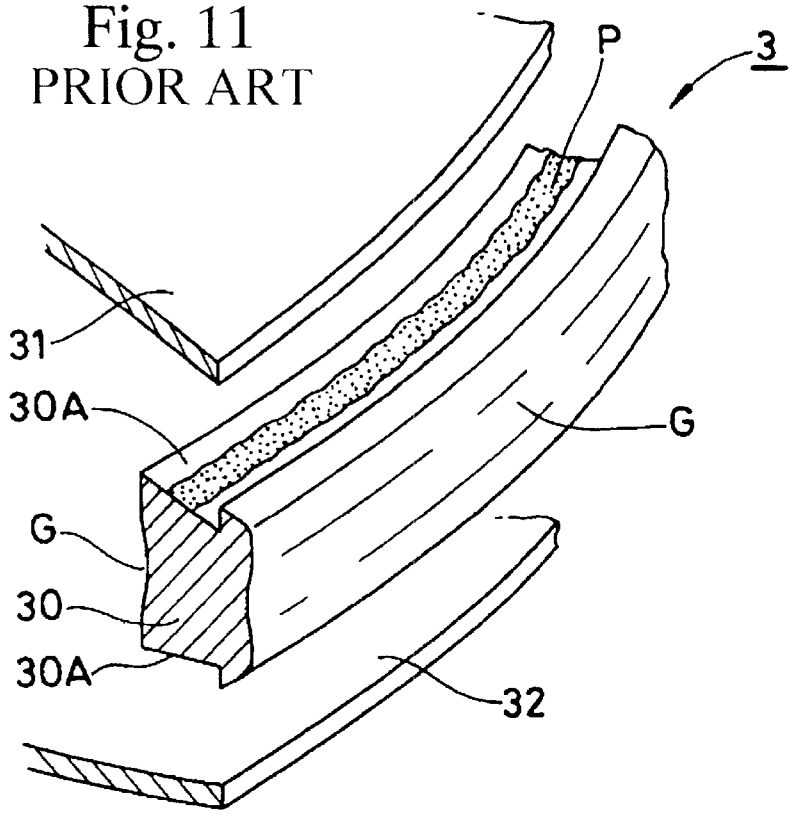
Fig. 11 PRIOR ART
FIG. 11 is a perspective view showing an assembly process of a body structure of a conventional string instrument.
Figure 12:
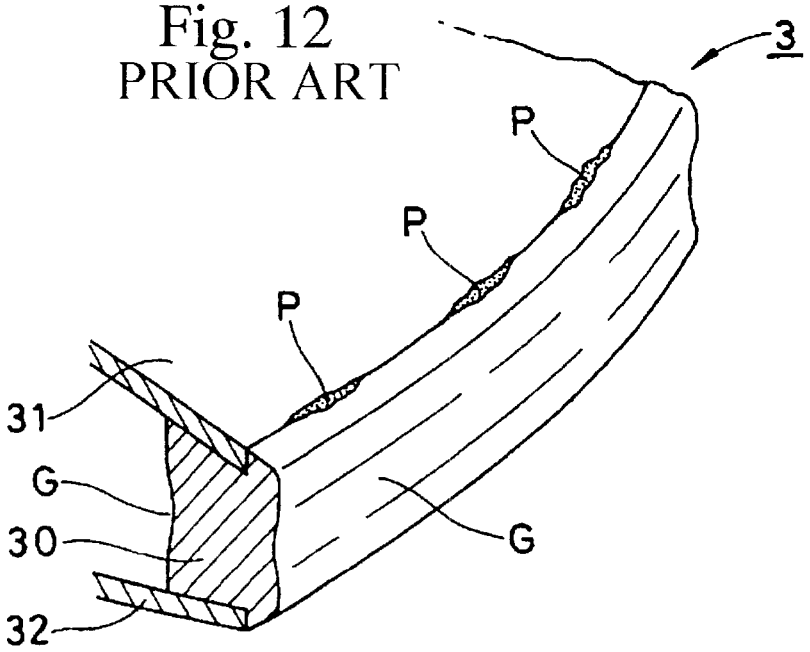
Fig. 12 PRIOR ART
FIG. 12 is a perspective view showing a deficiency in the assembly process shown in FIG. 11.

FIGS. 4 and 5 show the other embodiments of the present invention and, as seen in the figures, the rib member 10 and the body side frames 20 are formed as hollow frames by a forming method such as extrusion molding.

As described above in detail, according to the bonding structure of the present invention, the assembly of the rib member or the body side frame with the boards or the panel plates is performed by forming the rib member or the body side frame into an approximate H shaped cross-section having the internal and external flanges, coating the adhesive on the top and bottom surfaces of the internal flange, and by fitting and adhering the plate members to the rib member or the body side frame. Accordingly, it is possible to eliminate the overflow of the adhesive to the outside of the assembly, so that the marring of the outside surface can be prevented, which results in improving the productivity of the assembly process. Furthermore, the rib member or the body side frame of the present invention can be formed having no thick portion, which prevents formation of the shrinkage cavities due to the inhomogeneous cooling rate, which prevents degradation of the appearance and quality of the products. In addition, it is possible to lighten the entire assembly by forming the rib member or the body side frame into an approximate H-shaped cross-section. Furthermore, it is possible to lighten the entire assembly by forming such a hollow rib member or body side frame.

What is claimed is:

1. A musical instrument housing, comprising:

upper and lower boards, each board having an outer periphery;

a rib member extending between said upper and lower boards, said rib member including an inner and an outer flange which are spaced from each other and which extend between said upper and lower boards, said inner flange being adhered to said upper and lower boards, said outer flange resting against said upper and lower boards but not being adhered thereto.

2. The musical instrument housing according to claim 1, wherein said flange includes a connecting portion extending between said inner and outer flanges and spaced from said upper and lower boards.

3. The musical instrument according to claim 2, wherein an upper hollow space is defined between said inner and outer flanges, said connecting portion and said upper board.

4. The musical instrument according to claim 3, wherein glue us used to adhere said inner flange to said upper board and where excess glue is located in said upper hollow space.

5. The musical instrument according to claim 3, wherein a lower hollow space is defined between said inner and outer flanges, said connecting portion and said lower board.

6. The musical instrument according to claim 5, wherein glue us used to adhere said inner flange to said lower board and where excess glue is located in said lower hollow space.

7. The musical instrument according to claim 5, said outer flange rests against outer edges of said top and bottom boards.

8. The musical instrument according to claim 7, wherein said outer flange defines a portion of the outer periphery of said musical instrument.

* * * * *